US008714425B2

(12) United States Patent
Meyer et al.

(10) Patent No.: US 8,714,425 B2
(45) Date of Patent: May 6, 2014

(54) CINCH SACK BACKPACK WITH PADDED STRAPS

(75) Inventors: Michael J. Meyer, Baltimore, MD (US); Kerrie Timmons, Sparks, MD (US)

(73) Assignee: Under Armour, Inc., Baltimore, MD (US)

( * ) Notice: Subject to any disclaimer, the term of this patent is extended or adjusted under 35 U.S.C. 154(b) by 134 days.

(21) Appl. No.: 13/218,020

(22) Filed: Aug. 25, 2011

(65) Prior Publication Data

US 2013/0048691 A1 Feb. 28, 2013

(51) Int. Cl.
*B65D 33/28* (2006.01)
*A45F 3/12* (2006.01)

(52) U.S. Cl.
USPC ..... 224/643; 224/656; 383/75

(58) Field of Classification Search
USPC ..... 224/643, 579, 153, 601, 656; 383/75, 383/24, 26, 4, 61.4, 72; D3/244
See application file for complete search history.

(56) References Cited

U.S. PATENT DOCUMENTS

| | | | | |
|---|---|---|---|---|
| 86,403 | A | 2/1869 | Huntington | |
| 1,706,330 | A | 3/1929 | Sorg | |
| 2,552,443 | A | 5/1951 | Molinari | |
| 2,678,672 | A | 5/1954 | Spilman | |
| 2,815,785 | A | 12/1957 | Vail | |
| 4,674,664 | A * | 6/1987 | Simon | 224/604 |
| 4,858,797 | A * | 8/1989 | Rabska | 224/162 |
| 5,187,823 | A | 2/1993 | Ferguson et al. | |
| 5,490,619 | A | 2/1996 | Boyar | |
| 5,618,110 | A | 4/1997 | Sullivan | |
| 5,957,354 | A | 9/1999 | Mentken | |
| 5,988,879 | A | 11/1999 | Bredderman et al. | |
| 6,435,391 | B1 | 8/2002 | Vazquez | |
| 6,607,107 | B2 * | 8/2003 | Dexheimer | 224/604 |
| 7,448,522 | B2 * | 11/2008 | Collier et al. | 224/264 |
| D584,894 | S * | 1/2009 | McDaniel | D3/244 |
| D611,707 | S | 3/2010 | Hock | |
| D619,807 | S | 7/2010 | Hock | |
| 7,959,356 | B2 * | 6/2011 | Sommers | 383/16 |
| 2004/0179756 | A1 * | 9/2004 | Kani | 383/72 |
| 2006/0153477 | A1 | 7/2006 | Koguchi | |
| 2006/0228051 | A1 * | 10/2006 | Yu | 383/2 |
| 2007/0108240 | A1 | 5/2007 | Berger | |
| 2009/0190865 | A1 | 7/2009 | Chang | |
| 2010/0284631 | A1 * | 11/2010 | Lee | 383/12 |

* cited by examiner

*Primary Examiner* — Justin Larson
*Assistant Examiner* — Phillip Schmidt
(74) *Attorney, Agent, or Firm* — Maginot, Moore & Beck

(57) ABSTRACT

A bag configured to be worn or carried on the back by a user having a cinched top and including padded straps which extend over the user's shoulders. Each of the straps includes a strap member which may be a cord or a drawstring which is attached to the bottom of the bag and loops around the perimeter of the top of the bag. Each of the straps also includes a padded member which encircles a portion of the strap member to provide additional comfort to the user by cushioning the strap member and distributing the weight of the bag over a larger surface area.

18 Claims, 9 Drawing Sheets

CINCH SACK BACKPACK WITH PADDED STRAPS

FIELD

This application relates to the field of bags with carrying straps and particularly to bags worn on the back that have shoulder straps.

BACKGROUND

Bags to be worn on the back (generally called backpacks) are usually carried by two straps extending over the wearer's shoulders which bear the load carried in the bags. Backpacks vary widely in form and size to suit the user's needs. For hiking and camping expeditions, trekking backpacks may include internal or external frames made of carbon fiber or aluminum, have capacities of 100 liters, include specialized features to distribute weight and compartmentalize items and weigh 8 pounds when empty. For transporting a few lightweight items, cinch sacks (which may also be referred to as drawstring backpacks) are designed with straps that double as drawstrings to control the opening at the top of the bag. This design allows for simplicity as these bags may require as little as a simple sack and two drawstrings resulting in backpacks with capacities of around 8 liters and weights of just a few ounces.

When backpacks are loaded with a significant amount of weight, the distribution of weight over the relatively thin straps with little contact surface area on the wearer's shoulders may cause physical discomfort to the wearer as the straps impress the weight over a concentrated area. If a wearer must carry the backpack for a significant period of time, this discomfort may become substantial. Accordingly, many backpacks include comfort features to combat this issue. For example, trekking backpacks may include additional straps that cross the wearer's chest, waist and hips to better distribute the load. Backpacks of intermediate size, for carrying school books, for example, may have additional padding on the shoulder straps to decrease discomfort to the wearer. However, these types of bags may not be suitable or desirable for all applications. For example, a backpack may be oversized or too bulky for a particular application. In these situations, a cinch sack or drawstring backpack may be appropriate, but these backpacks do not typically include comfort features. In particular, a cinch sack or drawstring backpack may be uncomfortable to the wearer if significant weight is carried in the bag.

In view of the foregoing, it is desirable to provide an improved cinch sack backpack that causes less discomfort to a wearer when carrying heavier loads over longer periods of time. It would be advantageous if this backpack could include features which allow the cinch sack backpack to retain the desired simplicity for applications requiring a cinch sack backpack while improving the comfort of the user. A backpack including such features may increase the application of cinch sack backpacks as the comfort of the user carrying heavier loads over longer periods of time increases.

SUMMARY

In accordance with one embodiment of the disclosure, there is provided a carrying apparatus which includes a bag that is configured to be carried on a wearer's back. The bag includes a top and a bottom and strap members attached to the bag. The strap members are configured to extend over said wearer's shoulders. The strap members are also configured to slide to adjust an opening at the top of the bag. The bag also includes shoulder pads which are attached to the top of the bag and are configured to slidably retain the strap members.

Various embodiments of the carrying apparatus are possible. For example, the shoulder pads may be attached to opposite sides of the bag. The shoulder pads may also include longitudinal sheaths which are configured to encircle the strap members. The shoulder pads may also include a first opening at a first end of the shoulder pad and a second opening at a second end of the shoulder pad to allow passage of the strap member into and out of the longitudinal sheaths. The strap members may be drawstrings and the shoulder pads may include reinforcement rings configured to encircle the drawstrings. Alternatively, the strap members may be cords.

In accordance with another embodiment of the disclosure, the carrying apparatus may be a carrying bag which includes a top portion. The top portion defines an opening and the opening has a perimeter. The opening also defines a passage which extends along the perimeter. The carrying bag may also include a bottom portion opposite the top portion. The carrying bag may also include at least one drawstring attached to the bottom portion and configured to extend over a wearer's shoulders. Each of the at least one drawstrings may be slidably retained within the passage and each of the drawstrings includes two ends. The carrying bag may also include shoulder portions attached to the carrying bag. The shoulder portions are configured to slidably retain the drawstrings. The bottom portion may further include two bottom apertures configured to retain the ends of the drawstrings. The shoulder portions may include longitudinal passages configured to retain the drawstrings. The carrying bag may also include an exterior and an interior where the interior is configured to retain the ends of the drawstrings. Alternatively, the exterior may be configured to retain the ends of the drawstrings. The shoulder portions may include reinforcements configured to surround the drawstrings which may be cords.

Pursuant to yet another embodiment of the disclosure there is provided a carrying bag with a top portion and a bottom portion where the top portion may be in an open position which is configured to receive items or may be in a closed position which is configured to retain items. The top portion is in an open position when a relatively long length of drawstring is retained within a passage at the top portion of the bag. The top portion is in a closed position when a relatively short length of drawstring is retained within the passage at the top portion of the bag.

In accordance with yet another embodiment of the disclosure, a method of making a carrying apparatus includes forming a bag with an open top, a closed bottom and a passage around the open top. The method further includes attaching a first pad member to one side of the open top and a second pad member to an opposite side of the open top. A first drawstring is passed through the passage and a second drawstring is passed through the passage. In addition, the first drawstring is passed through the first pad member and the second drawstring is passed through the second pad member. The ends of the first and second drawstrings are coupled to the closed bottom of the bag. In one embodiment, the drawstrings may be passed through the pad members before they are passed through the passage. In another embodiment, the drawstrings may be passed through the pad members in a first direction, passed through the passage, and then passed back through the pad members in a second direction. The method may also include closing the open top by pulling the first and second drawstrings outwardly from the passage. The method may also include opening the open top by pulling the passage over the first and second drawstrings.

The above features and advantages, as well as others, will become more readily apparent to those of ordinary skill in the art by reference to the following detailed description and accompanying drawings. While it would be desirable to provide an article that provides one or more of these or other advantageous features, the teachings disclosed herein extend to those embodiments which fall within the scope of the appended claims, regardless of whether they accomplish one or more of the above-mentioned advantages.

DESCRIPTION

Figure 1:
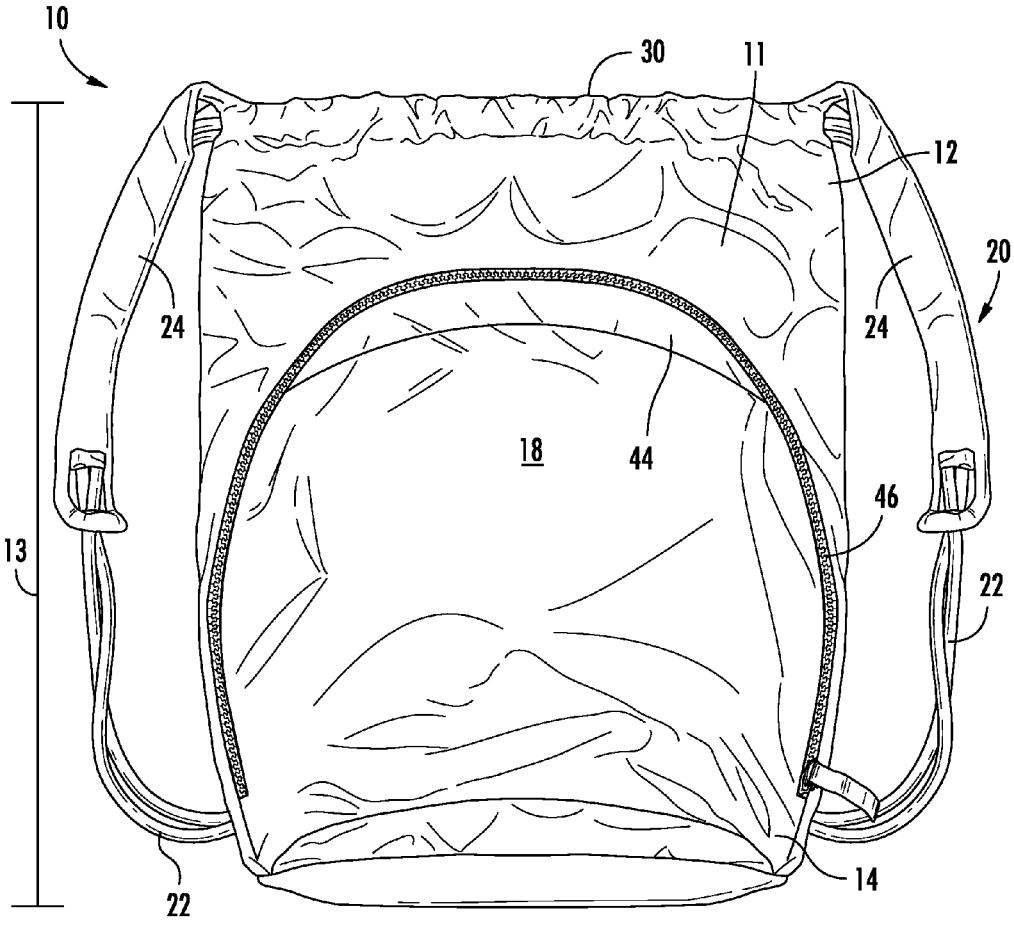
FIG. 1 shows a front view of a cinch sack including a bag and two strap arrangements to be worn over a user's shoulders.

With general reference to FIGS. 1-7, a carrying apparatus 10 is shown. The carrying apparatus 10 includes a bag 11 which defines a length 13 and includes a top portion 12, a bottom portion 14 and two strap arrangements 20. Each strap arrangement 20 includes a strap member 22 coupled to the bag 11 and a pad member 24 engaging the strap member 22. As described in further detail below, the strap members 22 are used to carry the bag 11 and the pad members 24 provide padding and weight distribution to the strap members 22.

The bag 11 may be provided in a number of different forms. One exemplary form of the bag 11 is shown in FIGS. 1-7. This form is a bag 11 designed and dimensioned to be carried on a user's back. Bags of this style are typically called backpacks, knapsacks, packs or rucksacks. To safely retain the contents within the bag, the bag may typically include one or more closing mechanisms including, for example, zippers, snaps, clips or drawstring cinches. The bag 11 shown in FIGS. 1-7 has a cinching top and may be referred to more specifically herein as a drawstring backpack or a cinch sack. While the bag 11 of FIGS. 1-7 has been shown as an exemplary embodiment of the carrying apparatus, it will be recognized that the bag 11 may be provided in any number of different forms configured to provide padding to drawstrings of a cinch sack.

Figure 2:
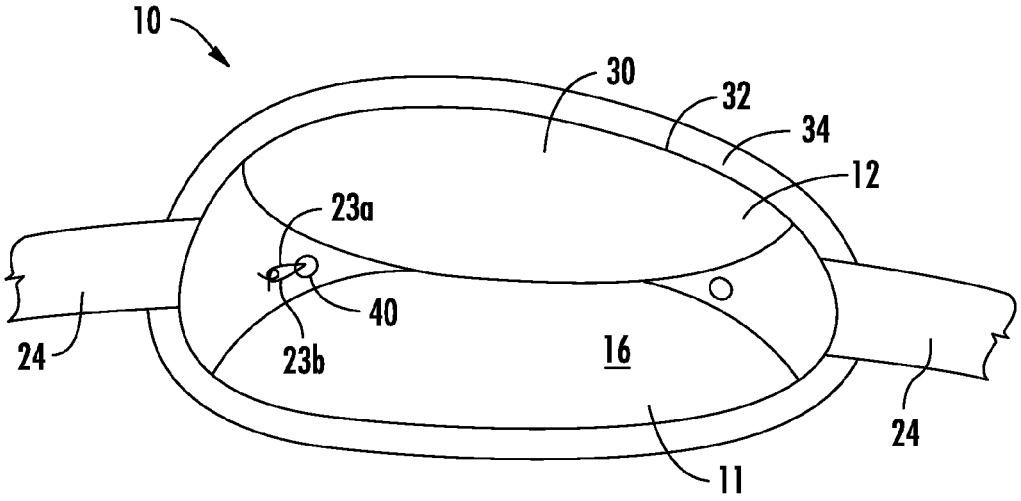
FIG. 2 illustrates a top view of the cinch sack of FIG. 1 with an enlarged opening exposing the interior of the bag.

Referring to FIGS. 1 and 2, a front view and a top view of the bag 11 are shown, respectively. The bag 11 defines an interior 16 (best shown in FIG. 2) and an exterior 18 (best shown in FIG. 1). As mentioned above, the bag 11 includes a top portion 12 and a bottom portion 14. An opening 30 to the interior 16 is found at the top portion 12 of the bag 11. A user may insert and remove items from the interior 16 of the bag 11 through this opening 30.

Figure 3:
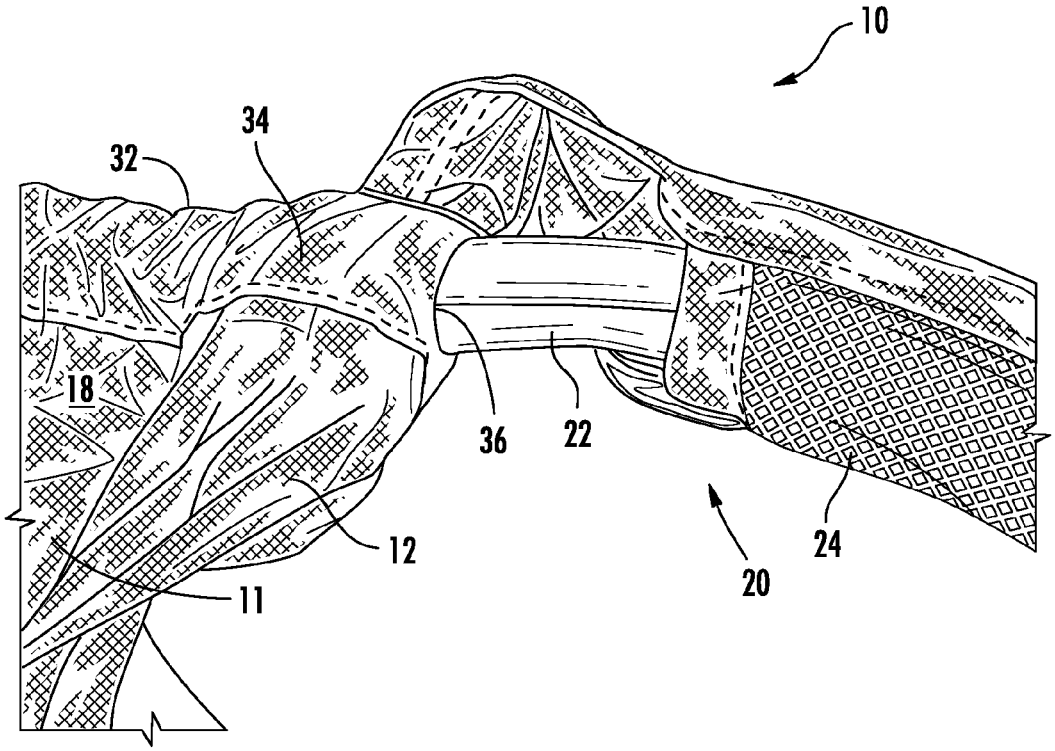
FIG. 3 shows a close up side view of strap arrangement attached to the top of the cinch sack of FIG. 1.

As shown in FIG. 2, the opening 30 defines a perimeter 32 which extends around the opening 30 at the top portion 12 of the bag 11. A passage 34 runs along the length of the perimeter 32. The passage 34 is designed and dimensioned to receive the strap members 22 (as shown in FIG. 1). As shown in FIG. 3, which shows a close up front view of the top portion 12 of the bag 11, the perimeter 32 also includes passage access openings 36 which provide access to the passage 34 from the exterior 18 of the bag 11. FIG. 3 shows one passage access opening 36 for clarity, while FIG. 4 demonstrates that there are two passage access openings 36 spaced apart from each other on the top portion 12 of the bag 11. While the embodiment shown in these figures demonstrates a bag 11 with two passage access openings 36, it will be understood that the bag 11 could alternatively include only one passage access opening 36 to the passage 34 in the perimeter 32 of the top portion 12 of the bag 11.

Referring again to FIG. 1, the bottom portion 14 of the bag 11 is closed to retain items placed inside the bag 11 which are pulled downwardly by gravity when the bag 11 is carried. FIG. 5 provides a close up back view of the bottom portion 14 of the bag 11 and shows a bottom aperture 40 designed and dimensioned to receive the ends of the strap members 22. The bottom aperture 40 provides access for the strap members 22 to extend from the exterior 18 to the interior 16 (shown in FIG. 2) of the bag 11. Alternatively, the bottom portion 14 could include a tab component on the exterior 18 of the bag 11 and the bottom aperture 40 could be defined on the tab component and pass through the exterior 18 without providing access to the interior of the bag 11. The bottom aperture 40 is surrounded by a reinforcement 42 which may be in the form of a reinforcement ring or grommet. This reinforcement may be in any form which improves the durability of the bottom aperture 40. Alternatively, the bottom aperture 40 may not include a separate reinforcement 42 around the bottom aperture 40. The bag 11 shown in FIG. 4 includes two bottom apertures 40 spaced apart from one another along the bottom portion 14 of the bag 11. Alternatively, the bag 11 may only include one bottom aperture 40.

Figure 4:
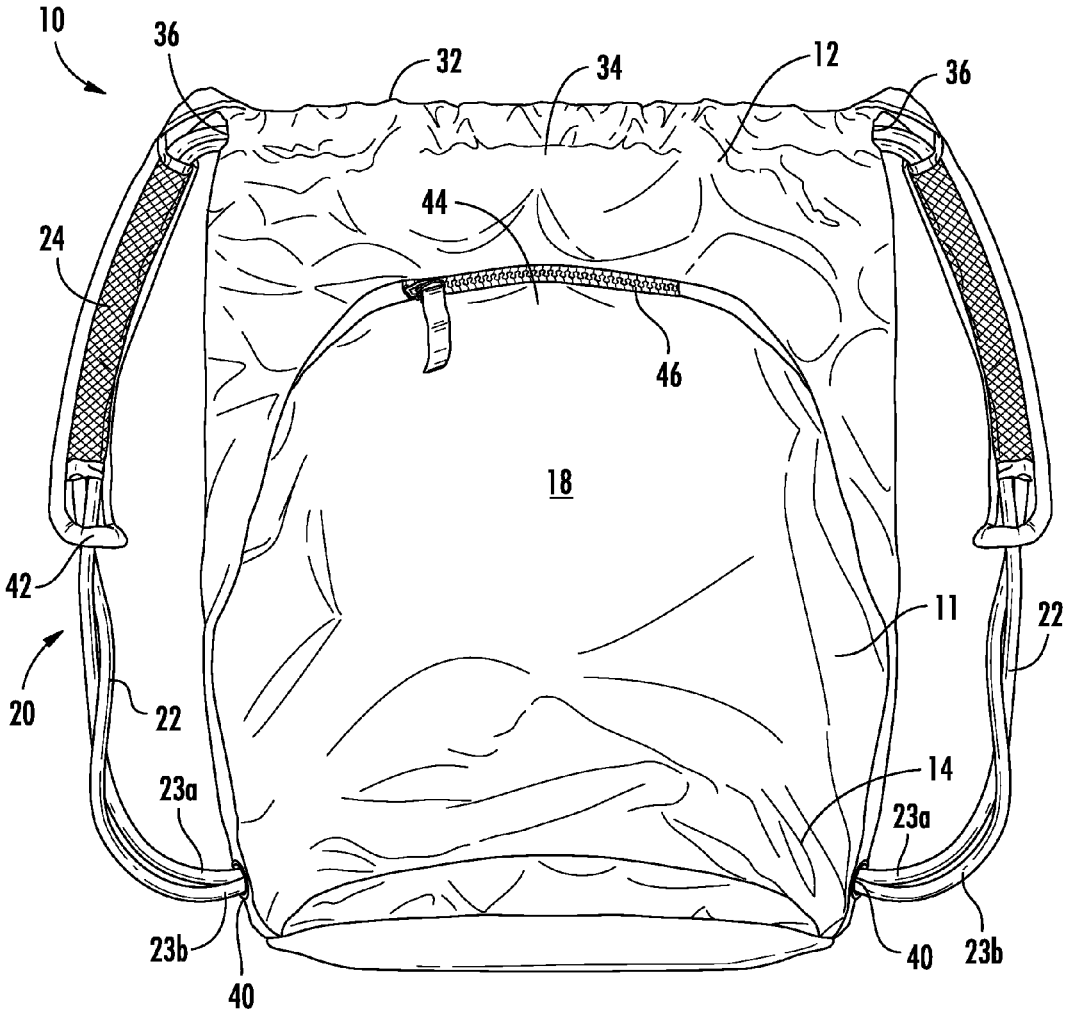
FIG. 4 shows a back view of the cinch sack of FIG. 1.
Figure 5:
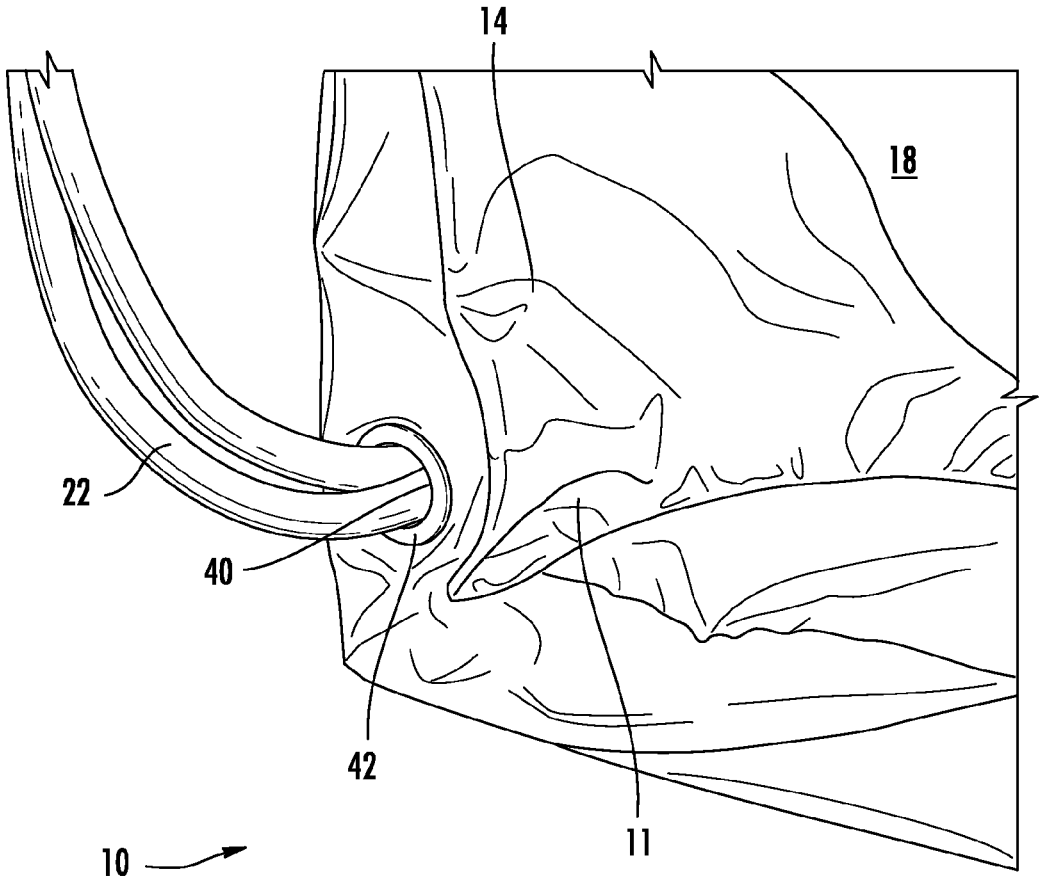
FIG. 5 shows a close up back view of the bottom of the cinch sack of FIG. 1 with the strap arrangement coupled to the bag.

As shown in FIGS. 1 and 4, the bag 11 may include separate pockets 44 on the exterior 18 of the bag 11. These pockets 44 may provide additional compartments for keeping items separated while carrying the bag 11. The pockets 44 include a closing mechanism 46 to retain the items within the pockets 44 when the bag 11 changes orientation or position. In the embodiment shown, the closing mechanism 46 is in the form of a zipper. However, the closing mechanism may also be in the form of, for example, a snap, button, tie or any other mechanism which can be readily opened and closed to access and use the pocket 44. In an alternative embodiment, the bag 11 may also include pockets 44 on the interior of the bag 11.

Referring generally to FIGS. 1, 3, 4, 6 and 7, the bag 11 also includes strap arrangements 20. Each strap arrangement 20 includes a strap member 22 and a pad member 24. Each strap member 22 is coupled to the top portion 12 and the bottom portion 14 of the bag 11 and is used to bear the weight of the bag 11 as well as to cinch the top portion 12 of the bag 11 closed to retain its contents. Each pad member 24 slidably receives a strap member 22 and is used to pad the strap member 22 and distribute the weight borne by the strap member 22. By providing padding for and distributing the weight of the strap members 22, the pad members 24 increase the comfort of the user, especially under conditions where the bag 11 will contain heavier contents or the user will carry the bag 11 for a longer period of time.

Figure 6:
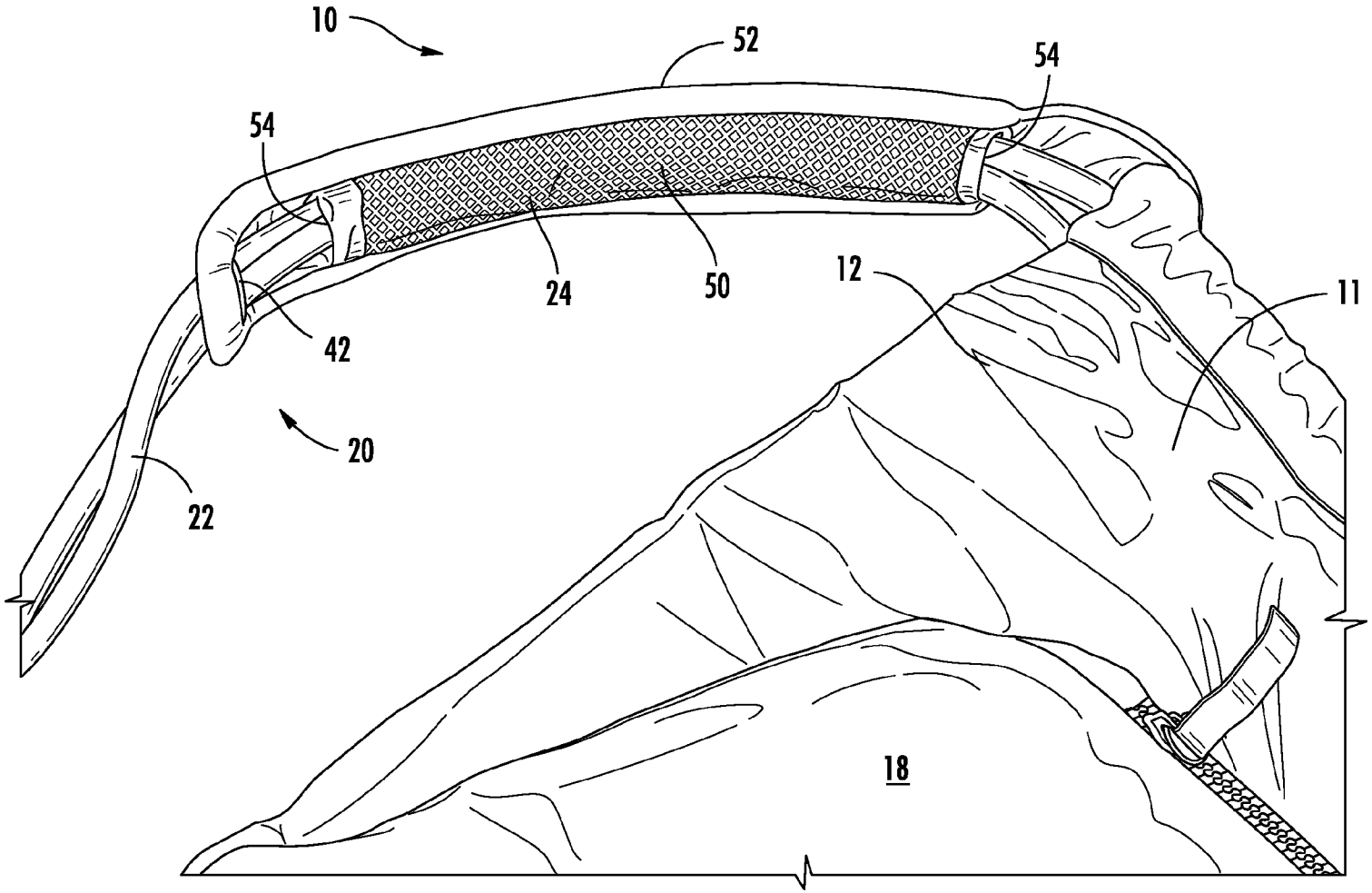
FIG. 6 shows a back view of one of the strap arrangements of the cinch sack of FIG. 1.

Best shown in FIG. 6, each pad member 24 includes a shoulder contact side 50 and a containment side 52. In one embodiment, the shoulder contact side 50 may include a soft mesh material which is flexible, absorbent and porous to provide the user with a forgiving, spongy contact surface, although other materials are possible. The shoulder contact side 50 may further include a flexible and malleable pad adjacent to the soft mesh material. The pad may be, for example, an open cell foam or other suitable pad material to accommodate movement of the user's shoulders with an internal cushion. Each pad member 24 further includes an internal channel which extends between the shoulder contact side 50 and the containment side 52 along the length of the pad member 24. The longitudinal channel or longitudinal sheath 54 is sized and shaped so that strap members 22 can fit inside and slide freely within the pad members 24.

Each pad member 24 is fastened to the top portion 12 of the bag 11 on the interior 16 (shown in FIG. 2) of the bag 11. Only one end of each pad member 24 is fastened to the top portion 12 of the bag 11 with the opposite end of the pad member 24 moveable with respect to the bag 11 in a flap like manner. This allows the pad member 24 to extend over the shoulder of the user when the bag 11 is worn on the back. When the pad members 24 extend over the shoulders of the user, the shoulder contact side 50 of the pad member 24 will contact the user's shoulder to provide padding and weight distribution. The containment side 52 of the pad member 24 will face away from the user's shoulder and provide the remaining portion of the longitudinal sheath 54. The pad members 24 do not extend the entire length 13 (shown in FIG. 1) of the bag 11.

Each pad member 24 also includes reinforcements 42 which are located on the opposite side of the longitudinal sheath 54 from the location at which the pad member 24 attaches to the top portion 12 of the bag 11. As noted above, the reinforcements 42 may be in the form of reinforcement rings or grommets or any other form which provides improved durability for the pad members 24.

Best shown in FIG. 4, the strap members 22 are coupled to both the top portion 12 and the bottom portion 14 of the bag 11. Each strap member 22 is in the form of a drawstring or a cord and has two ends 23: a first end 23*a* and a second end 23*b*. In one embodiment, the strap member 22 may be a cord which has a generally round cross-section, although other shapes are possible. In another embodiment, the strap member may be a cord which has a length of approximately 100 to 200 centimeters and a diameter of approximately one centimeter, although it will be recognized that many other lengths and diameters are possible. In some embodiments, the strap members 22 may be cords which are made of an elastic material and are relatively stretchable in a longitudinal direction, although other materials are possible. For example, the strap members 22 may be comprised of elastane or other fibers. Alternatively, the strap members 22 can be in any form which is relatively thin and flexible and can be used as a strap to carry a bag.

The strap members 22 are coupled to the bottom portion 14 of the bag via the bottom apertures 40. As shown in FIG. 4, the ends 23*a*, 23*b* of the strap members 22 pass through the bottom aperture 40 from the exterior 18 to the interior 16 (shown in FIG. 2) of the bag 11. As shown in FIG. 2, on the interior 16 of the bag 11, the ends 23*a*, 23*b* are retained on the interior 16 side of the bottom aperture 40 by being tied in a knot. Alternatively, the ends 23 may be retained by any other method which will prevent the ends 23 from passing through the bottom aperture 40 from the interior 16 to the exterior 18 of the bag 11.

Referring generally to FIGS. 3-6, the strap members 22 are inserted through the reinforcements 42 at the bottom portion 14 of the bag 11 (best shown in FIG. 5), inserted through the reinforcements 42 on the pad member 24 (best shown in FIG. 6), inserted through the longitudinal sheaths 54 (best shown in FIG. 6), inserted through the passage access openings 36 (best shown in FIG. 3), fed through the entire passage 34 and exit the passage 34 through the same passage access openings 36 through which they were inserted (best shown in FIG. 3). The strap members 22 are then inserted back through the longitudinal sheaths 54, the reinforcements 42 on the pad member 24 and the reinforcements 42 at the bottom aperture 40 on the bottom portion 14 of the bag 11. This relationship of the strap members 22 to the top portion 12, bottom portion 14 and pad members 24 of the bag 11 provides the strap arrangements 20 which connect the top portion 12 and bottom portion 14 of the bag 11 to allow for carrying of the bag 11 and integrate the pad members 24 into the strap arrangements 20 to allow for increased comfort and weight distribution on the strap members 22 while carrying the bag 11. The embodiment shown in these figures includes two strap arrangements 20 spaced apart from one another on the bag 11. In an alternative embodiment, the bag 11 could include a single strap arrangement 20 configured so that the bag 11 would extend across only one shoulder and the chest of a user when the bag 11 is worn on the back.

Figure 8A:
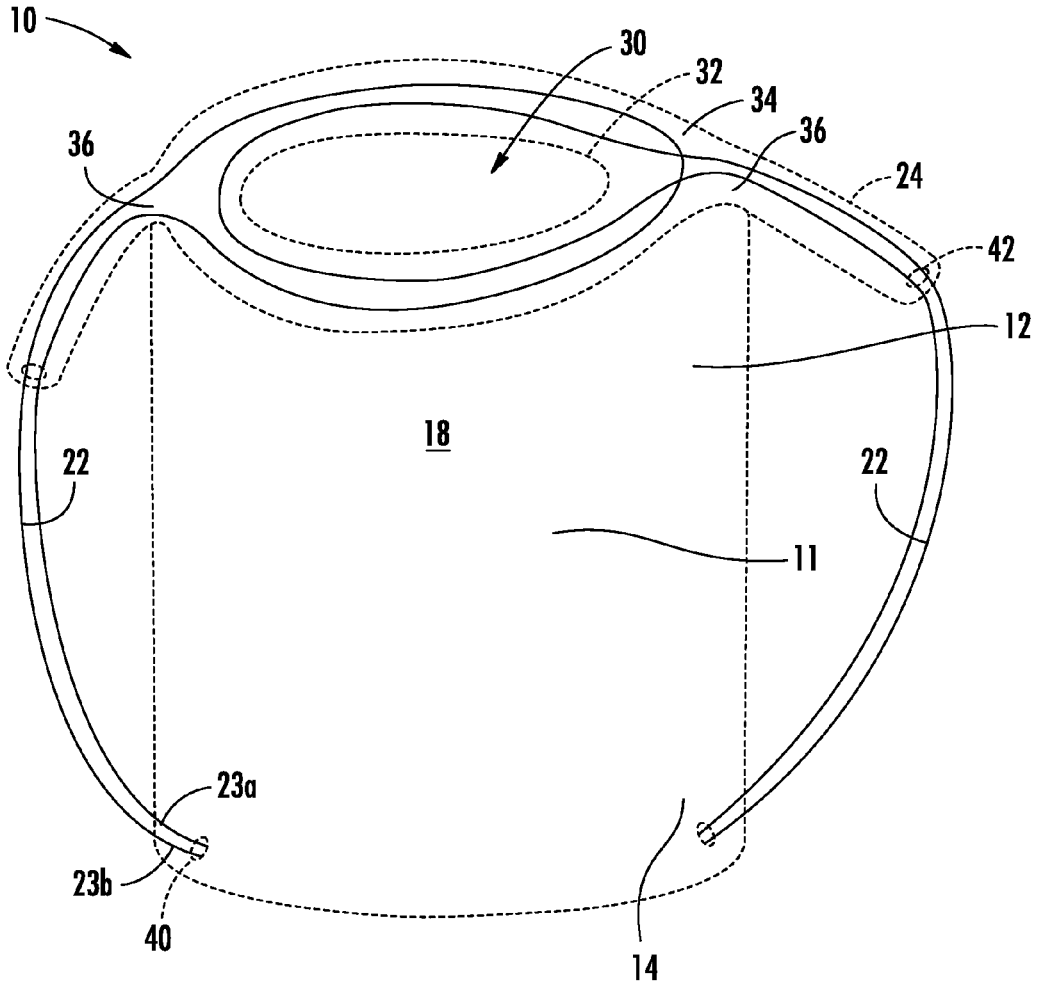
FIG. 8A illustrates the arrangement of straps of the strap arrangement on the in relation to the bag when the bag is fully opened.
Figure 8B:
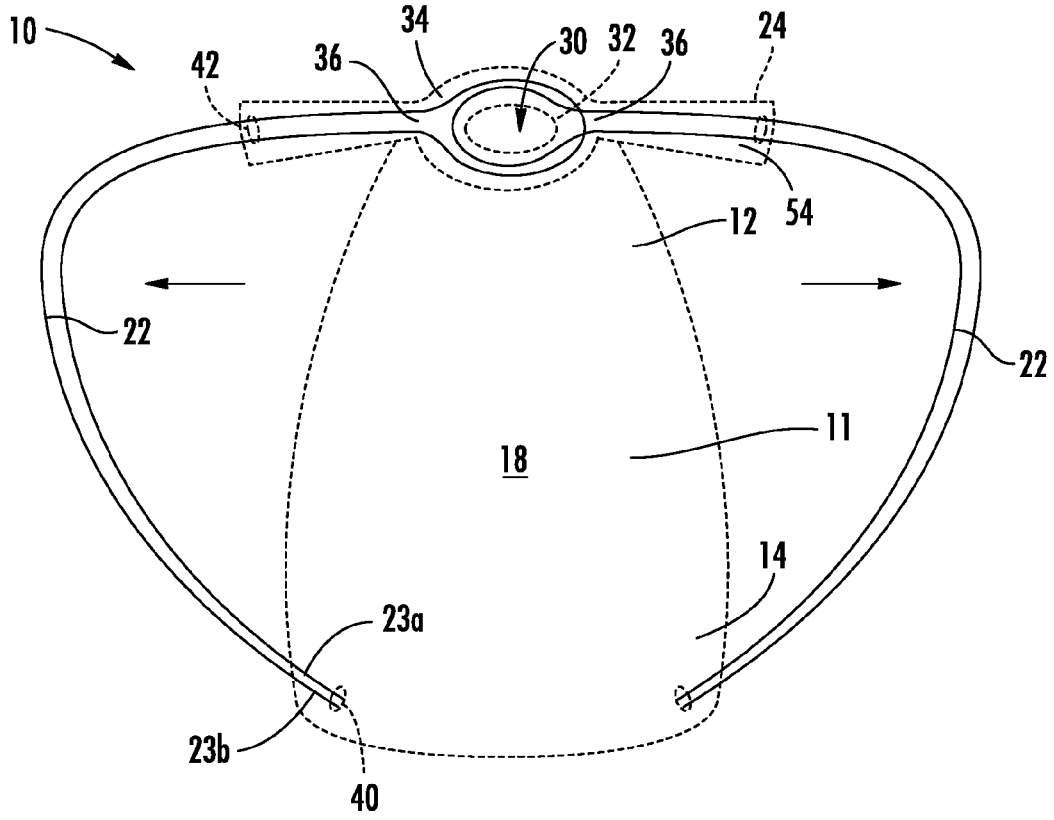
FIG. 8B illustrates the arrangement of the straps of FIG. 8A when the bag is closed.

The arrangement of the strap members 22 in relation to the pad members 24 and bag 11 is generally illustrated in FIGS. 8A and 8B, where the strap members 22 are shown in solid lines and the pad members 24 and bag 11 are shown in dotted lines in order to more clearly show the routing of the strap members 22. FIG. 8A shows the arrangement of the strap members 22 with the opening 30 in an enlarged/fully open position. FIG. 8B shows the arrangement of the strap members with the opening in a reduced/closed position. As shown in FIGS. 8A and 8B, the strap members 22 form overlapping loops within the top passage 34 of the bag. While strap members 22 are illustrated herein as being single continuous elongated members, it will be recognized that each strap member 22 may alternatively be comprised of multiple elongated members that are linked together at end portions to form the strap member (e.g., multiple pieces of short cord tied together, adhered, or otherwise connected at their ends to form a longer cord).

With continued reference to FIGS. 8A and 8B, as well as FIGS. 2, 5 and 6 (as referenced below), a method of manufacturing a carrying apparatus may be created by the following steps. The interior 16 (shown in FIG. 2) and exterior 18 of the bag 11 are created providing the top portion 12 with a perimeter 32 as the open side of the bag 11 and the bottom portion 14 as a closed side of the bag 11. The passage 34 is created within the perimeter 32 of the top portion 12 of the bag 11 and passage access openings 36 are formed between the passage 34 and the exterior 18 of the bag 11. The bottom apertures 40 are created and reinforced with reinforcements 42 (shown in FIG. 5). The pad members 24 are formed by attaching the shoulder contact sides 50 (shown in FIG. 6) and the containment sides 52 (shown in FIG. 6) while leaving a longitudinal sheaths 54 (shown in FIG. 6) open between the two. The reinforcements 42 are added to the pad members 24 (shown in FIG. 6). The first ends 23*a* of the strap members 22 are retained on the interior 16 of the bottom portion 14 of the bag 11. The second ends 23*b* of the strap members 22 are threaded through the reinforcement 42 at the bottom portion 14 of the bag 11, are threaded through the reinforcements 42 on the pad members 24, are threaded through the longitudinal sheaths 54 on the pad members 24, are threaded through the passage access openings 36 at the top portion 12 of the bag 11 and are threaded through the passage 34 around the perimeter 32 of the opening 30 at the top portion 12 of the bag 11. When the second ends 23*b* of the strap members 22 have been threaded around the entire passage 34 and return to the passage access openings 36 through which they entered the passage 34, they begin to double back on themselves. Thus, the threading described above can be considered to occur in a first direction. Once the strap members 22 double back on themselves, they will complete the rest of the threading, described below, in a second direction. The second ends 23*b* of the strap members 22 are threaded back through the passage access openings 36, back through the longitudinal sheaths 54, back through the reinforcements 42 on the pad members 24 and back through the reinforcements 42 at the bottom aperture 40 in the bottom portion 14 of the bag 11. The first and second ends 23*a*, 23*b* are then tied in knots on the interior 16 of the bag 11 to prevent either end 23 from being pulled back through the bottom aperture 40. Although the steps provided above are necessarily listed in an order, it is not necessary that the steps be performed in the order above or in any specific order. Any order of the steps which arrives at the bag 11 is suitable for creating the bag 11 shown in FIGS. 4 and 7.

In use, the bag 11 is worn on the back of a user and the two strap arrangements 20 extend over the shoulders of the user. The strap members 22 of the strap arrangements 20 are coupled to the bottom of the bag 11 and are threaded through passage access openings 36 and through the passage 34 which extends around the perimeter 32 of the opening 30 at the top portion 12 of the bag 11. The passage access openings 36 are spaced apart on the top portion 12 of the bag 11 so that the strap members 22 enter the passage access openings 36 at spaced apart locations. Thus, when both strap members 22 are pulled outwardly from the passage 34 (in the direction shown by the arrows in FIG. 8B), they pull the strap members 22 through the passage 34 in opposing directions which causes the opening 30 at the top portion 12 of the bag 11 to collapse inwardly. In this way, the bag 11 is reconfigured from having an open top in an open configuration (best shown in FIGS. 1 and 8A) to having a closed top in a closed configuration (best shown in FIGS. 7 and 8B). When the bag 11 is in the closed configuration, it will retain items within the interior 16 of the bag 11 when the orientation or position of the bag 11 changes. The position of the pad members 24 (shown with dashed lines in FIGS. 8*a* and 8*b*) relative to the strap members 22 allows the user to convert the bag 11 from the open configuration to the closed configuration while the user is wearing the bag 11 without the strap members 22 rubbing the user's shoulder's during the conversion. The pad members 24 contact the user's shoulders instead of the strap members 22 during this conversion and prevent uncomfortable chafing and irritation by the thinner and less padded strap members 22.

Figure 7:
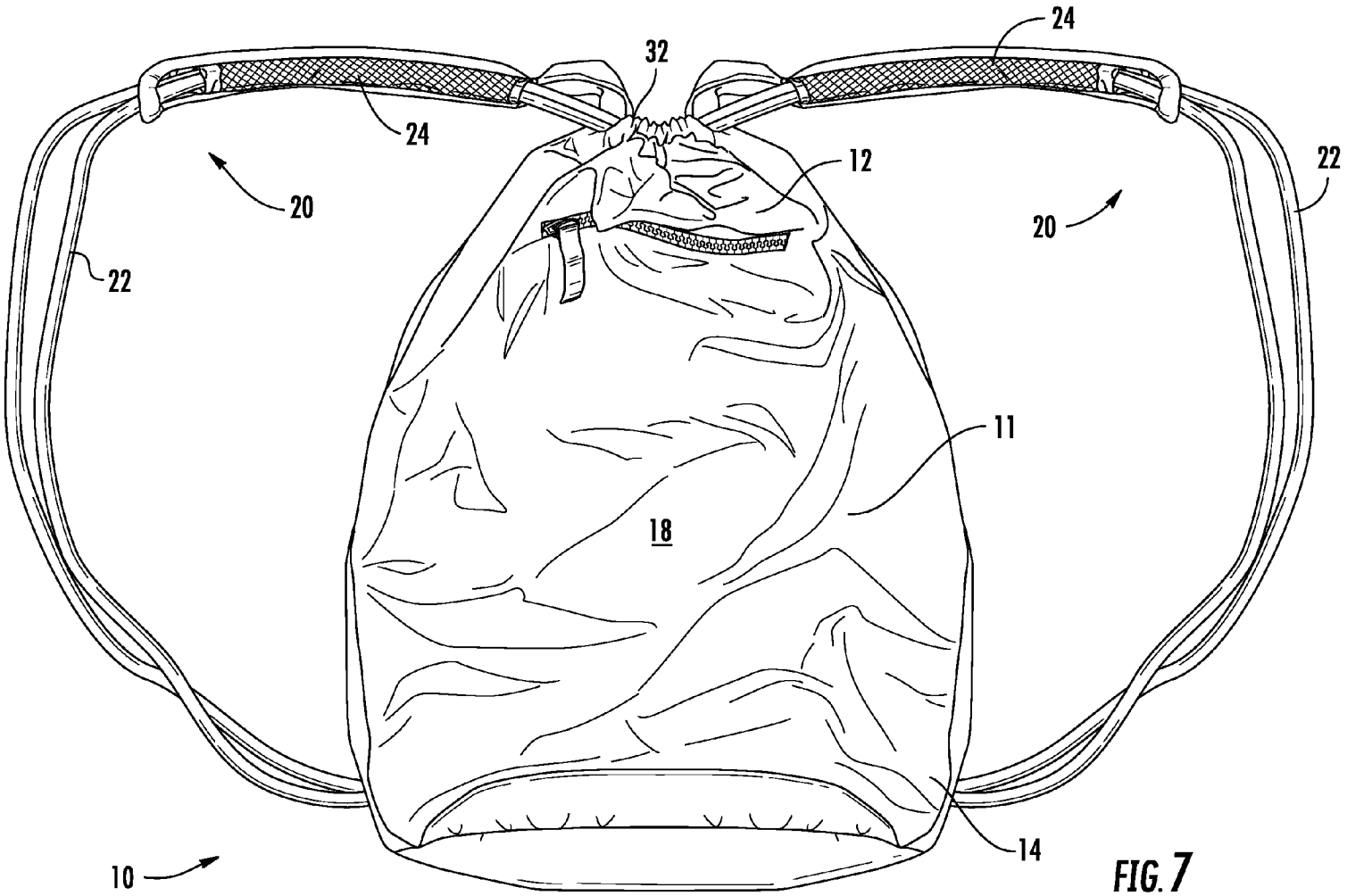
FIG. 7 shows a back view of the cinch sack of FIG. 1 with the top of the bag cinched closed.

Referring to FIGS. 4, 6 and 7, when the bag 11 is being worn by the user, the strap members 22 extend over the user's shoulders and bear the weight of the contents of the bag. Because the strap members 22 are relatively thin, the weight of the bag is concentrated on a small amount of the surface area of the user's shoulders. This may cause discomfort if the items in the bag 11 are heavy or must be carried for an extended period of time. Thus, in use, the strap arrangements 20 of the bag 11 also include shoulder pads or padded straps 24 which are wider and more padded than the strap members 22. In this embodiment, the shoulder pads or shoulder portions are referred to as pad members. The strap members 22 pass through the pad members 24 between the bottom portion 14 and the top portion 12 of the bag so that the pad members 24 will be oriented over the user's shoulders when the bag 11 is on the user's back. The pad members 24 have a shoulder contact side 50, which is cushioned and soft, and will rest on the user's shoulders to provide added padding and weight distribution and improve the comfort of the user.

The foregoing detailed description of one or more embodiments of the backpack with padded straps has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed embodiments and other features and functions, or alternatives thereof, may be desirably combined into many other different embodiments, systems, or applications. Presently unforeseen or unanticipated alternatives, modifications, variations or improvements therein may be subsequently made by those skilled in the art which are also intended to be encompassed by the appended claims. Therefore, the spirit and scope of any appended claims should not be limited to the description of the embodiments contained herein.

What is claimed is:

1. A carrying apparatus configured to be carried by a wearer, said carrying apparatus comprising:

a bag configured to be carried on a wearer's back, said bag including a top and a bottom;

strap members coupled to said bag and configured to extend over said wearer's shoulders, said strap members configured to slide to adjust an opening at said top of said bag, said bag including a passage configured to slidably receive said strap members and configured to extend around said opening at said top of said bag, said passage including at least one passage access opening configured to provide access to the passage; and shoulder pads attached to said top of said bag above said passage access opening and configured to slidably retain said strap members.

2. The carrying apparatus of claim 1, wherein said shoulder pads include longitudinal sheaths configured to encircle said strap members.

3. The carrying apparatus of claim 2, wherein:

said longitudinal sheaths include a first opening at a first end and a second opening at a second end, said first and second openings being configured to receive said strap members, and said shoulder pads are attached to said top of said bag such that said at least one passage access opening is accessible adjacent to one of said first end and said second end of said longitudinal sheaths.

4. The carrying apparatus of claim 3, wherein each longitudinal sheath includes a longer first panel and a shorter second panel, said first panel attached to said top of said bag above said passage access opening.

5. The carrying apparatus of claim 4, wherein one of said strap members is accessible between said passage access opening and said second panel.

6. The carrying apparatus of claim 3, wherein said strap members are able to be grasped between said at least one passage and said one of said first end and said second end of said longitudinal sheaths.

7. A carrying bag comprising:

a top portion defining an opening having a perimeter and including a passage which extends along said perimeter;

a bottom portion opposite said top portion;

at least one drawstring coupled to said bottom portion and configured to extend over a wearer's shoulders, said at least one drawstring extending to said top portion and slidably retained within said passage, said passage including at least one orifice configured to pass said at least one drawstring; and at least one shoulder portion attached to said carrying bag above said at least one orifice, said at least one shoulder portion configured to slidably retain said at least one drawstring.

8. The carrying bag of claim 7, wherein said at least one drawstring comprises two drawstrings and said at least one shoulder portion comprises a first and a second shoulder portion wherein the first shoulder portion is attached to one side of the carrying bag and the second shoulder portion is attached to an opposite side of the carrying bag.

9. The carrying bag of claim 7, wherein said at least one shoulder portion includes a first side configured to contact one of said wearer's shoulders and said at least one shoulder portion includes a second side irremovably coupled to said top portion of said carrying bag.

10. The carrying bag of claim 7, wherein said shoulder portions include longitudinal passages configured to retain said drawstrings.

11. The carrying bag of claim 7, further comprising an exterior and an interior, said interior being configured to retain ends of said drawstrings.

12. The carrying bag of claim 7, wherein said top portion is in an open position and is configured to receive items when a relatively long length of said drawstrings is retained within said passage.

13. The carrying bag of claim 7, wherein said top portion is in a closed position and is configured to retain items when a relatively short length of said drawstrings is retained within said passage.

14. A method for creating a carrying apparatus comprising:

forming a bag with an open top, a closed bottom, a passage around said open top, a first orifice leading into the passage on a first side of said open top, and a second orifice leading into the passage on a second side of said open top;

attaching a first pad member to the first side of said open top above the first orifice and a second pad member to the second side second side of said open top above the second orifice;

passing a first drawstring through said passage and passing a second drawstring through said passage;

passing said first drawstring through said first pad member and passing said second drawstring through said second pad member; and coupling ends of said first and second drawstrings to said closed bottom.

15. The method of claim 14, further comprising closing said open top by pulling said first and second drawstrings outwardly from said passage.

16. The method of claim 14, further comprising opening said open top by pulling said passage over said first and second drawstrings.

17. The method of claim 14 wherein said first and second drawstrings are passed through said passage before said first and second drawstrings are passed through said first and second pad members.

18. The method of claim 14 wherein said first drawstring is passed through said first pad member in a first direction, then passed through said passage, then passed back through said first pad member in a second direction and said second drawstring is passed through said second pad member in said first direction, then passed through said passage, then passed back through said second pad member in said second direction.

* * * * *